US009243849B2

(12) United States Patent
Saumweber et al.

(10) Patent No.: US 9,243,849 B2
(45) Date of Patent: Jan. 26, 2016

(54) STACKED PLATE HEAT EXCHANGER WITH END PLATE EXPANSION SLOTS

(75) Inventors: Christian Saumweber, Stuttgart (DE); Friedrich Brotz, Reutlingen (DE); Arthur Strehlau, Stuttgart (DE); Frank von Lützau, Berglen (DE)

(73) Assignee: MAHLE International GmbH, Stuttgart (DE)

( * ) Notice: Subject to any disclaimer, the term of this patent is extended or adjusted under 35 U.S.C. 154(b) by 1123 days.

(21) Appl. No.: 12/659,586

(22) Filed: Mar. 15, 2010

(65) Prior Publication Data

US 2010/0258095 A1 Oct. 14, 2010

(30) Foreign Application Priority Data

Mar. 12, 2009 (DE) ..... 10 2009 012 784

(51) Int. Cl.
*B60H 1/00* (2006.01)
*F28D 9/00* (2006.01)

(52) U.S. Cl.
CPC ..... *F28D 9/005* (2013.01); *F28F 2265/26* (2013.01)

(58) Field of Classification Search
CPC ..... F28F 9/0231; F28F 9/0221; F28F 9/0226; F28F 9/001; F28F 9/0236; F28F 9/0241
USPC ..... 165/41, 81, 82, 83, 149, 166, 167, 170
See application file for complete search history.

(56) References Cited

U.S. PATENT DOCUMENTS

| | | | | |
|---|---|---|---|---|
| 6,474,408 | B1 * | 11/2002 | Yeh et al. | 165/82 |
| 6,843,311 | B2 | 1/2005 | Evans et al. | |
| 7,121,331 | B2 | 10/2006 | Yoshida et al. | |
| 7,377,308 | B2 | 5/2008 | Ware | |
| 2004/0182547 | A1 | 9/2004 | Birkert et al. | |
| 2005/0034843 | A1 * | 2/2005 | Schindler et al. | 165/83 |
| 2005/0155749 | A1 | 7/2005 | Memory et al. | |

(Continued)

FOREIGN PATENT DOCUMENTS

| | | |
|---|---|---|
| DE | 694 04 108 | 10/1997 |
| EP | 1 001 241 | 5/2000 |

(Continued)

OTHER PUBLICATIONS

English Machine Translation of EP-0647824.*

*Primary Examiner* — Travis Ruby
(74) *Attorney, Agent, or Firm* — Walter Ottesen P.A.

(57) ABSTRACT

A heat exchanger has a plurality of intermediate plates arranged one atop the other to form a stack having first and second ends. At least one first fluid channel through conducts a first fluid and at least one second fluid channel through conducts a second fluid. The intermediate plates are geometrically configured to define at least a portion of each of the first and second fluid channels. An end plate is arranged on one of the ends of the stack and a first inlet opening communicates with the first fluid channel for introducing the first fluid and a first outlet opening communicates with the first fluid channel for conducting the first fluid out of the heat exchanger. A second inlet opening communicates with the second fluid channel for introducing the second fluid and a second outlet opening communicates with the second fluid channel for conducting the second fluid away from the heat exchanger. The end plate has at least one expansion zone for reducing the stiffness thereof.

24 Claims, 7 Drawing Sheets

(56) References Cited

U.S. PATENT DOCUMENTS

| | | | | |
|---|---|---|---|---|
| 2007/0199680 | A1 | 8/2007 | Helms et al. | |
| 2008/0041556 | A1 * | 2/2008 | Braun et al. | 165/41 |
| 2008/0245507 | A1 | 10/2008 | Agee | |

FOREIGN PATENT DOCUMENTS

| | | | |
|---|---|---|---|
| JP | 58-221391 | | 12/1983 |
| JP | 61-223496 | | 10/1986 |
| WO | WO 2009/062739 | A1 | 5/2009 |

* cited by examiner

STACKED PLATE HEAT EXCHANGER WITH END PLATE EXPANSION SLOTS

CROSS REFERENCE TO RELATED APPLICATION

This application claims priority of German patent application no. 10 2009 012 784.4, filed Mar. 13, 2009, the entire content of which is incorporated herein by reference.

BACKGROUND OF THE INVENTION

Heat exchangers are utilized in various technical applications for transferring heat from one fluid to another fluid. Heat exchangers are especially used in motor vehicles as charge-air coolers to cool the air, which is compressed by a compressor, ahead of being supplied to the engine. Here, the charge air, which is to be cooled, and a cooling liquid are passed through the heat exchanger. The cooling liquid or coolant takes up heat from the charge air and thereby cools the charge air. Heat exchangers of this kind are subjected to high loads as a consequence of temperature changes because, during operation of the motor vehicle, temperature fluctuations occur and, furthermore, for each start of the engine, the heat exchanger is at first cold.

Heat exchangers in a plate configuration are often used for charge-air coolers. Many plates are stacked one atop the other. Because of the geometry of the plates, channels, that is, fluid channels, for the charge air and the coolant are formed between the plates. End plates are mounted at the respective ends of the stack. The intermediate plates and the end plates are, in general, firmly bonded to each other by soldering. The thickness of the end plates is significantly greater than the thickness of the intermediate plates.

Distortions within the heat exchanger occur because of thermal cycling and/or because of an inhomogeneous temperature distribution within the heat exchanger. The distortions result especially from the larger thermal inertia of the end plates compared to the intermediate plates. The end plates have a greater thickness and therefore a larger mass so that the end plates heat up significantly slower or cool down slower than the intermediate plates. Furthermore, the stiffness of the end plates parallel to a plate plane is greater than the stiffness of the intermediate plates parallel to an intermediate plate plane. This difference in stiffness between the end plates and the intermediate plates can lead to damage that becomes manifest by a limited service life for the heat exchanger. Changes in size of the end plate because of temperature changes parallel to the plate plane differ from the change in size for temperature changes at the intermediate plate next to the end plate parallel to the intermediate plate plane.

SUMMARY OF THE INVENTION

In view of the above, it is an object of the invention to provide a heat exchanger and an internal combustion engine having the heat exchanger of simple construction which has a long service life even for high thermal cycling. The heat exchanger is cost effective to manufacture and is reliable during operation.

The heat exchanger of the invention includes: a plurality of intermediate plates arranged one atop the other to form a stack of the intermediate plates and the stack having first and second ends; at least one first fluid channel for through conducting a first fluid; at least one second fluid channel for through conducting a second fluid; the intermediate plates being geometrically configured to define at least a portion of each of the first and second fluid channels; an end plate arranged on one of the ends of the stack; a first inlet opening communicating with the first fluid channel for introducing the first fluid; a first outlet opening communicating with the first fluid channel for conducting the first fluid out of the heat exchanger; a second inlet opening communicating with the second fluid channel for introducing the second fluid; a second outlet opening communicating with the second fluid channel for conducting the second fluid away from the heat exchanger; and, the end plate having at least one expansion zone for reducing the stiffness thereof.

The stiffness relates to the entire at least one end plate and not only to the material of the at least one end plate from which the end plate is manufactured. For the same force which acts on the one end plate, preferably, parallel to the plate plane, a larger expansion occurs in the heat exchanger of the invention at the end plate.

The expansion zone can be defined by a recess in the at least one end plate which reduces the stiffness of the at least one end plate advantageously parallel or in the direction of the plate plane of the end plate. In this way, the difference in stiffness between the intermediate plates and the end plate is less (or there is no difference present any longer) so that, in this way, significantly less distortion and stress occur between the end plate and the intermediate plates so that the service life of the heat exchanger is significantly lengthened. The at least one recess has only the function to reduce the stiffness of the at least one end plate and/or to reduce the mass of the at least one end plate. The recess has no further function such as the function of an inlet opening or an outlet opening for introducing or discharging a fluid or as a device for fixing the heat exchanger.

In a further embodiment, the intermediate plates have openings for configuring the at least one first fluid channel and/or the at least one second fluid channel. The intermediate plates are arranged in a stack one atop the other so that the openings form a fluid channel perpendicular to the plate plane or the intermediate plate plane. The fluid channels, which are formed between the plates, are aligned parallel to the plane of the intermediate plates or the plane of the end plates.

In a further embodiment, a reinforcing plate is arranged between the end plate and the intermediate plate. The reinforcing plate reduces the jump in stiffness between the end plate and the intermediate plate. Preferably, the reinforcing plate has a thickness which lies between the thickness of the end plate and the thickness of the intermediate plate. The reinforcing plate can also be considered as an end plate and can be configured with at least one recess for reducing the stiffness of the at least one reinforcing plate, in the same manner as the at least one end plate.

The at least one recess is especially configured as a longitudinal slot and/or as a transverse slot and/or the at least one recess functions exclusively to reduce the stiffness of the at least one end plate, especially parallel to the plate plane of the at least one end plate and/or the at least one recess functions exclusively to reduce the mass and therefore the thermal inertia of the at least one end plate.

In a further embodiment, two regions, which are divided by the recess, of the end plate are connected to each other by at least one expansion rib or strut.

In an expanded embodiment, an end plate is configured as a connecting plate or a cover plate having at least one inlet opening for the first and/or second fluid and at least one outlet opening for the first and/or second fluid.

Preferably, the expansion of the connecting plate parallel to the plate plane is greater than the expansion of the intermediate plates parallel to an intermediate plate plane so that the connecting plate has an overhang relative to the intermediate plates and, on the overhang, at least one device is provided for fixing the heat exchanger.

In a variation, the at least one device is at least one bore and/or at least a threaded fastener.

The at least one recess for reducing the stiffness of the end plate is configured in addition to the at least one bore and/or the at least one inlet opening and/or the at least one outlet opening in the at least one end plate.

In a further embodiment, the thickness of the end plate is greater than the thickness of the intermediate plates. The thickness of the intermediate plate is the material thickness of the intermediate plate so that geometric formations of the configuration of the fluid channels are not considered for the expansion of the intermediate plate perpendicular to the intermediate plate plane.

The thickness of the one end plate is especially greater than the thickness of the intermediate plate by at least 1.5 or 2.0, preferably 3.0 or 4.0 times greater than the thickness of an intermediate plate.

In a further embodiment, the material thicknesses of the intermediate plates are essentially the same, especially, the thicknesses of the intermediate plates exhibit a difference of less than 30% or 20% or 10%.

In an expanded variation, the end plates and/or the intermediate plates are, at least in part, made of metal such as steel or aluminum.

In a further variation, the at least one recess of an end plate is configured perpendicular to the plate plane of the at least one end plate and the at least one recess completely passes through the at least one end plate.

In a further variation, the at least one recess of the at least one end plate is configured perpendicularly to the plate plane of the at least one end plate and the at least one recess extends only partially through the at least one end plate.

In a further embodiment, the intermediate plates are firmly bonded to each other especially via soldering and/or the at least one end plate is firmly bonded to the intermediate plate especially by soldering.

A turbulence insert is arranged especially in the at least first fluid channel and/or the at least one second fluid channel and, especially, the turbulence insert is attached, preferably via soldering to two intermediate plates. The turbulence insert generates a turbulent flow in the at least one first fluid channel and in the at least one second fluid channel to improve the heat transfer from the first fluid to the second fluid or vice versa.

In a further embodiment, the intermediate plates have impressions so that the at least one first fluid channel and the at least one second fluid channel (which form between two intermediate plates) have either nobs or embossments at the boundaries of the fluid channels so that, in this way, the surface for heat transfer is increased and, furthermore, a turbulent flow can be facilitated.

Advantageously, an internal combustion engine 900 is provided with a compressor, for example, a turbocharger 700 or a compressor 910 for compressing the charge air supplied to the engine and a heat exchanger 1 for cooling the charge air compressed by the compressor. With the heat exchanger, the compressed charge air and a coolant can be conducted through for transfer of heat from the compressed charge air to the coolant. The heat exchanger is configured in the manner described herein.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
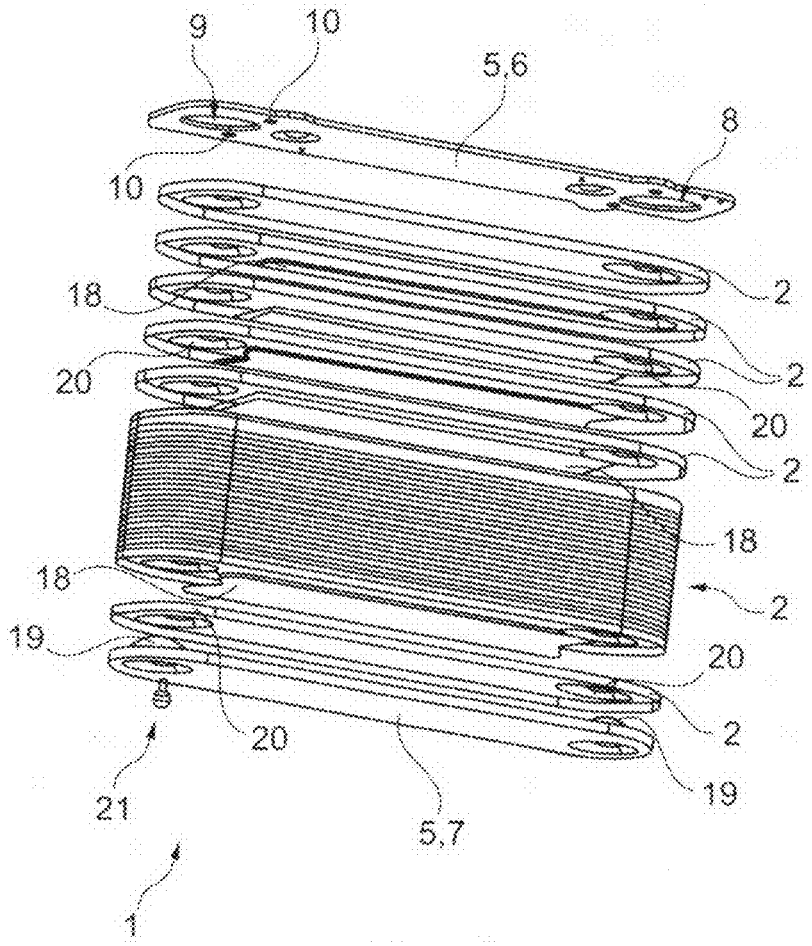
Fig. 1 Prior Art
FIG. 1 is an exploded perspective view of a heat exchanger known from the prior art.
Figure 2:
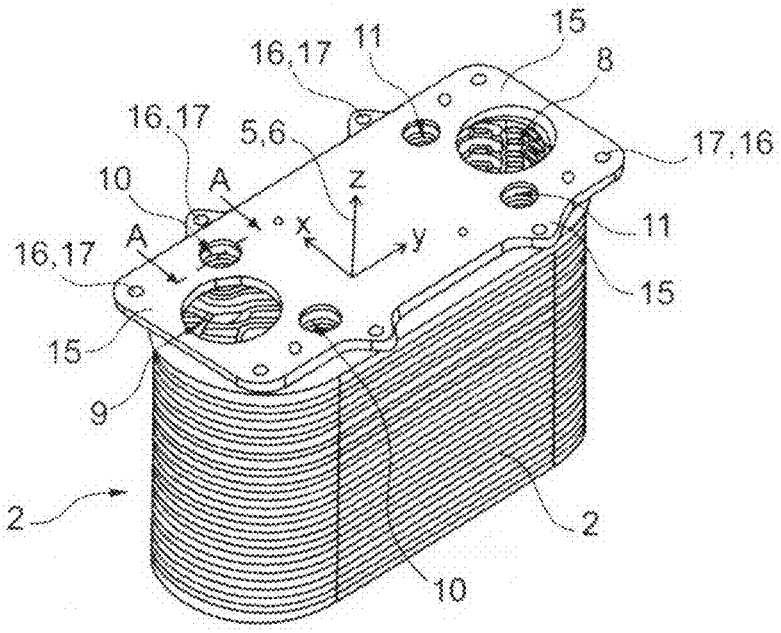
Fig. 2 Prior Art
FIG. 2 is a perspective view of the heat exchanger of FIG. 1.
Figure 3:
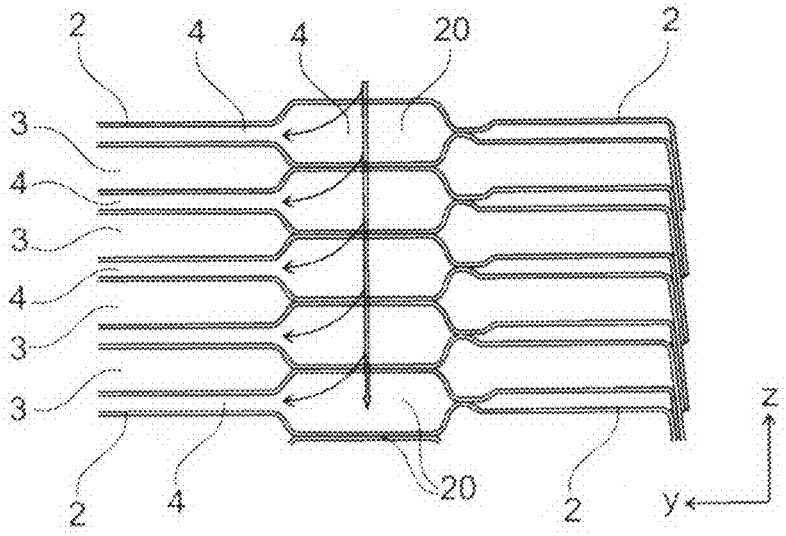
Fig. 3 Prior Art
FIG. 3 is a section view of the heat exchanger taken along section A-A of FIG. 1.

In FIGS. 1 to 3, a heat exchanger 1 known from the prior art is shown. The heat exchanger 1 has a plurality of intermediate plates 2 which are arranged one atop the other to form a stack. Respective end plates 5 are arranged at the ends of the stack. A first end plate 5 is configured as a connecting plate 6. The connecting plate 6 has a large inlet opening 8 for introducing a first fluid, that is, charge air. Furthermore, the connecting plate 6 has a large outlet opening 9 for conducting the charge air out of the heat exchanger 1. Two small inlet openings 10 in the connecting plate 6 serve to introduce a cooling liquid or coolant as a second fluid and two outlets 11 serve for discharging the coolant as the second fluid.

A right-angled coordinate system having (X, Y, Z) axes of the heat exchanger 1 is aligned to the connecting plate 6 so that the X-axis and the Y-axis lie on the surface of the planar connecting plate 6 and the Z-axis is aligned perpendicular to the surface of the connecting plate 6 (FIG. 2). The X-axis and the Y-axis of the coordinate system lie within a plate plane of the connecting plate 6 or end plate 5. The connecting plate 6 has a larger expansion parallel to the plate plane of the connecting plate 6 or in the X-axis and/or Y-axis than the intermediate plates 2 in the direction of the X-axis and Y-axis so that an overhang 15 on the connecting plate 6 is formed relative to the stack made up of the intermediate plates 2 (FIG. 2). Bores 17 are formed on the overhang 15 as a means 16 for fastening the heat exchanger 1. Threaded fasteners or bolts, for example, can be introduced into the bores 17. With these threaded fasteners or bolts, the heat exchanger 1 can be fixed to another part, for example, a component of a motor vehicle having corresponding connecting lines for the coolant or the charge air.

At a second end of the stack, an end plate 5 is present (FIG. 1) configured as a cover plate 7. The cover plate 7 includes two domes 19. The identically-configured intermediate plates 2 have openings 20 for forming a first fluid channel 3 and a second fluid channel 4. In FIG. 1, the openings 20 of the intermediate plates 2 are not shown. These openings configure the second fluid channels 4 (in this embodiment four in number) in the direction of the Z-axis. Viewed in the direction of the Z-axis, the openings 20 of the intermediate plates 2 are configured in the same way as in the connecting plate 6. In this way, in the direction of the Z-axis of the heat exchanger 1, two large first fluid channels 3 are formed in the intermediate plates 2 for through conducting the charge air and four small second fluid channels 4 are formed for through conducting the coolant in the direction of the Z-axis.

In FIG. 3, a section view is shown taken along line A-A of FIG. 2 through the second fluid channel 4 for the coolant. According to FIG. 3, the coolant flows through the circularly-shaped openings in the intermediate plates 2 in the direction of the Z-axis and, from this flow in the direction of the Z-axis, corresponding smaller flow quantities are through conducted in second fluid channels 4 for the coolant. The second fluid channels 4 are aligned in the direction of the X-axis and/or Y-axis. These second fluid channels, which are aligned in the direction of the X-axis and/or Y-axis, form between each two intermediate plates 2. In the same way, the charge air is conducted through two large first fluid channels 3 in the direction of the Z-axis and, from this flow with charge air, in the direction of the Z-axis, component quantities of charge air are introduced into the first fluid channels for the charge air (not shown) aligned in the direction of the X-axis and/or Y-axis.

In FIG. 3, only these first fluid channels 3 are shown which are aligned in the direction of the X-axis and/or Y-axis. The expansion of the first fluid channels 3 between two intermediate plates 2 in the direction of the Z-axis is then greater than the expansion of the second fluid channels 4 between two intermediate plates in the direction of the Z-axis. This is necessary because, for the charge air, a greater volume or a greater flow cross section is needed than for the coolant in the second fluid channels 4. In the first and second fluid channels (3, 4), turbulence inserts 18 are furthermore provided. The second fluid channels (3, 4) are aligned between each two intermediate plates 2 in the direction of the X-axis and/or Y-axis. The turbulence inserts 18 are not shown in FIG. 3 and are shown in FIG. 1 only simplified as plate-shaped. The turbulence inserts 18 have, in cross section, a zigzag-shaped geometry and serve for developing a turbulent flow in the first and second fluid channels (3, 4) which are aligned in the X-axis and/or Y-axis.

The plate plane of the intermediate plates 2 is parallel to the plate plane of the end plate 5 in the arrangement of stacked intermediate plates 2 and the end plate 5 in the stack lying one atop the other. The end plates 5 have a significantly greater expansion in the X-axis and Y-axis than in the Z-axis. The plate plane is defined because of this greater expansion in the X-axis and Y-axis. The X-axis and Y-axis lie within the plate plane. In the same manner, the expansion of the intermediate plates 2 in the X-axis and Y-axis is significantly greater than in the Z-axis. The X-axis and Y-axis define the intermediate plate plane of the intermediate plates 2.

The intermediate plates 2 and the end plates 5 are soldered to each other. This applies also for the turbulence inserts 18. In addition, one of the two end plates 5 is provided with a drain plug or threaded plug 21 (FIG. 1) for closing off drain opening 22. Domes 19 of the cover plate 7 close off the two large openings 20 of the intermediate plates 2 at the cover plate 7 (FIG. 1).

According to another embodiment (not shown), the two end plates are connected to each other by means of threaded fasteners so that the cover plate also has a threaded fastener bore for passing through a bolt or threaded rod.

Figure 4:
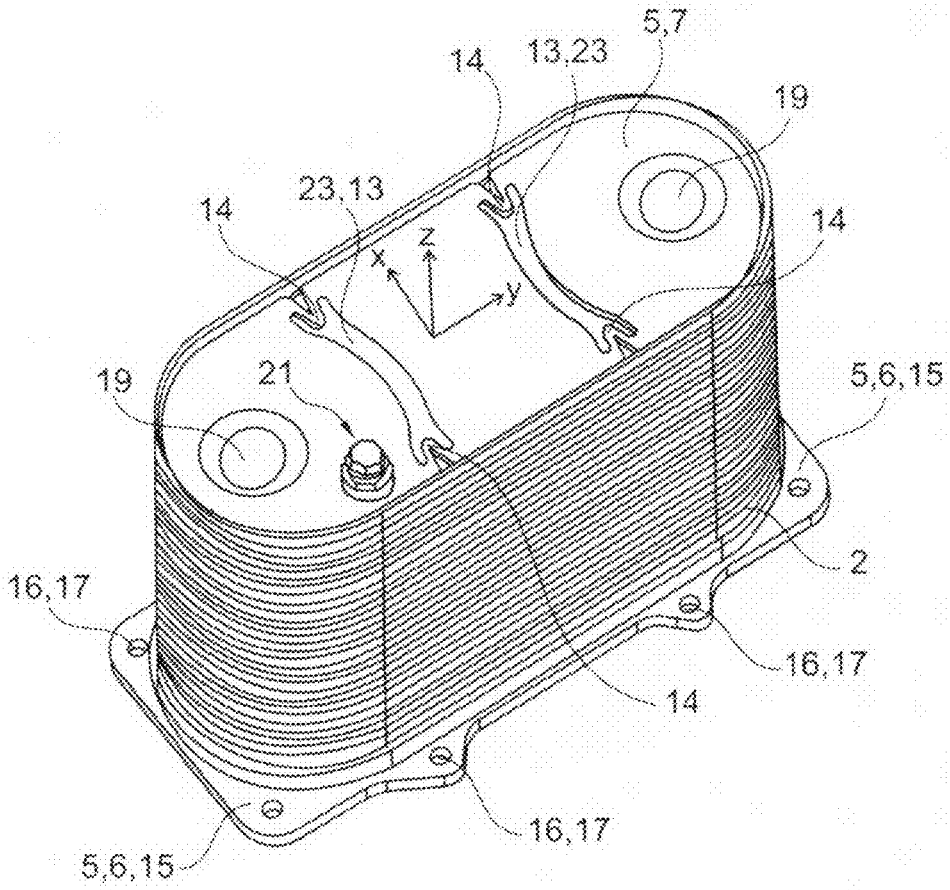
FIG. 4 is a schematic showing the heat exchanger of the invention according to a first embodiment.
Figure 5:
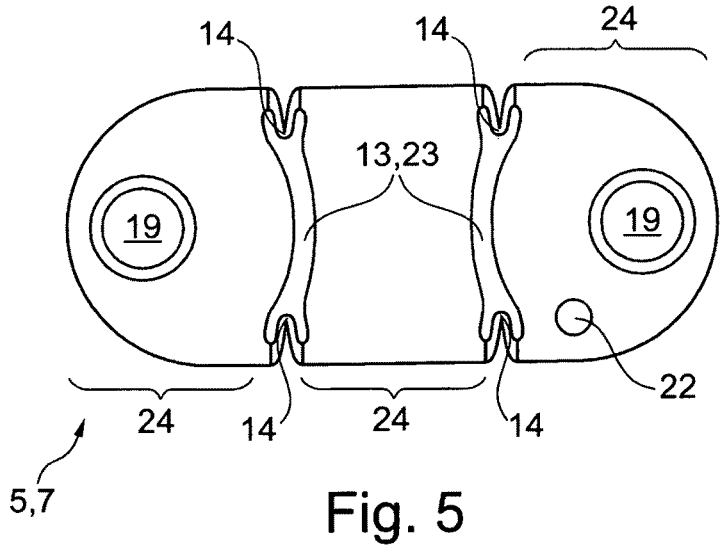
FIG. 5 is a plan view of a cover plate of the heat exchanger of FIG. 4; and, FIG. 6 is a perspective view of the cover plate of the heat exchanger of the invention in accordance with a second embodiment.

A first embodiment of the heat exchanger 1 of the invention is shown in FIGS. 4 and 5. Hereinafter in the heat exchanger 1 according to the invention, essentially only the differences to the heat exchanger 1 of FIGS. 1 to 3 are described. The cover plate 7 as end plate 5 has two recesses 23 which are configured as transverse slots 13. The transverse slots 13 subdivide the cover plate into three regions 24 in the longitudinal direction, that is, in the Y-direction of the cover plate 7. These regions 24 of the cover plate 7 are connected to each other by expansion struts 14. The stiffness of the cover plate 7 parallel, to the plate plane or in the direction of the X-axis and/or Y-axis is thereby significantly less than the stiffness of the cover plate 7 according to FIGS. 1 and 2 and known from the prior art. In this way, for an inhomogeneous temperature distribution within the heat exchanger 1 or for thermal cycling, in an advantageous manner, significantly less deformations occur between the cover plate 7 and the intermediate plate 2 at the cover plate 7. Accordingly, damage, for example, leaks between the cover plate 7 and the intermediate plate 2, are prevented and the service life of the heat exchanger 1 is thereby significantly lengthened. The plate plane of the cover plate 7 corresponds to the plane of the drawing of FIG. 5.

In addition, the stresses can be reduced by the provision of a support plate or reinforcement plate between the cover plate and the intermediate plate. Especially advantageous is such a support plate or reinforcement plate thicker than one of the intermediate plates but thinner than the cover plate.

Figure 6:
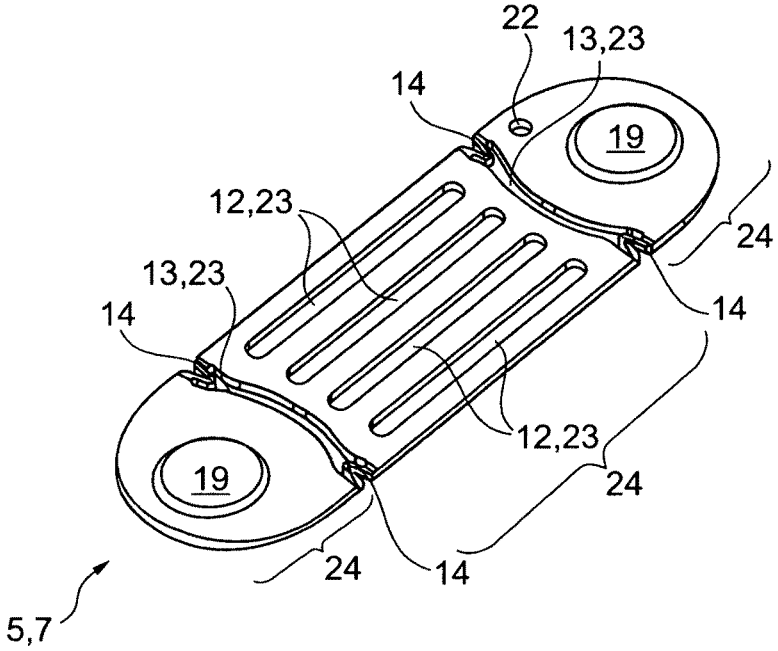
Figure 7:
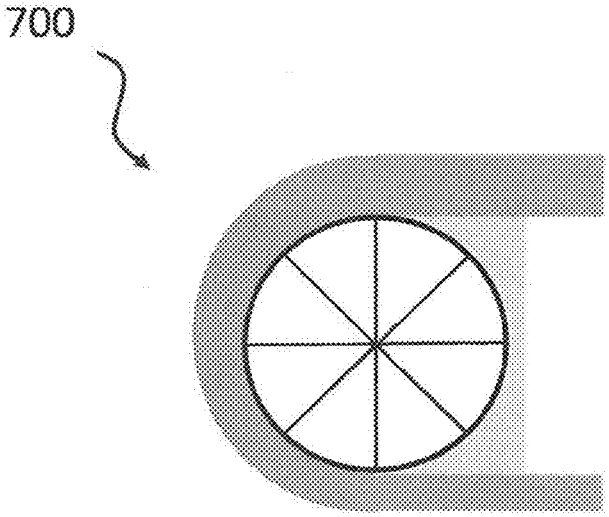
FIG. 7 depicts a schematic representation of a turbocharger 700.
Figure 8:
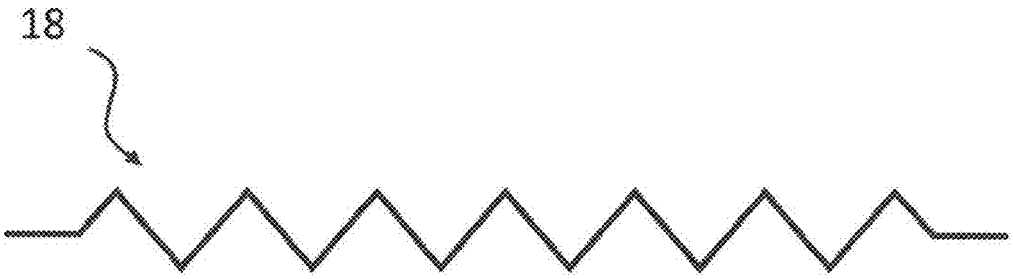
FIG. 8 is a cross section view of a turbulence insert 18 having a zig-zag shaped geometry.
Figure 9:
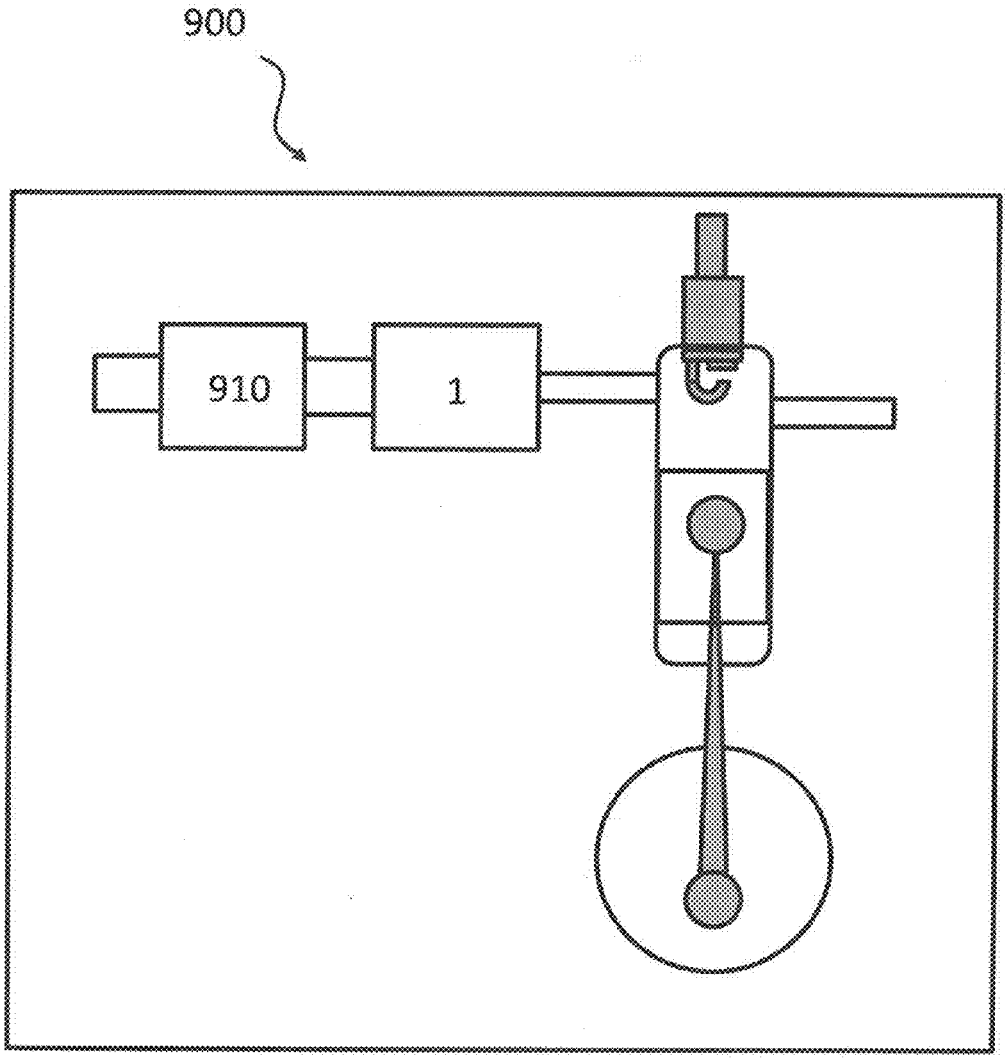
FIG. 9 depicts a schematic representation of an internal combustion engine 900 having a compressor 910.
Figure 10:
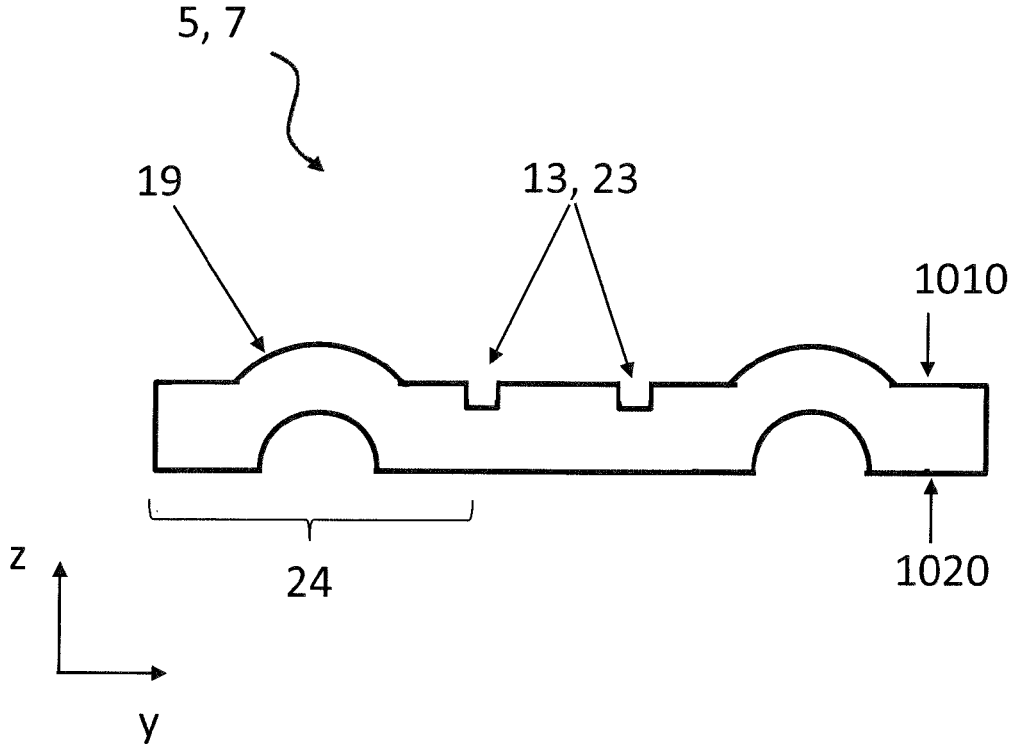
FIG. 10 is a section view of cover plate 7 shown in FIG. 5. The section extends through the center of the cover plate along the y-axis. The cover plate has a first surface 1010 facing the plate stack and a second surface 1020 that is parallel to the first surface and faces away from the plate stack.

In the second embodiment shown in FIG. 6, the cover plate 7 has four longitudinal slots 12 as recesses 23 and two transverse slots 13. In the same manner as in the first embodiment, expansion struts 14 are provided at the transverse slots 13. In this way, and in an analogous manner to the first embodiment, the stiffness of the cover plate 7 is reduced in the X-axis and Y-axis and thereby the service life of the heat exchanger is significantly increased.

The intermediate plates 2 and the end plates 5 of the heat exchanger 1 comprise at least partially aluminum and are firmly bonded to each other by soldering.

Viewed overall, significant advantages are associated with the heat exchanger 1 of the invention. The stiffness of the end plates 5 parallel to the plate plane is reduced essentially because of the configuration of the recesses 23 so that the stresses between the end plates 5 and the intermediate plates 2 become less and damage can thereby be avoided. In this way, the service life of the heat exchanger 1 is increased in an advantageous manner with a minimum of technical complexity. The recesses 23 can be cut out in a simple manner, for example, by a stamping operation or milling operation, a water jet or laser cutting from the blank for manufacturing the end plates 5. In this way, the cost to manufacture the heat exchanger is increased only very slightly and, in exchange, the service life of the heat exchanger 1 is significantly increased.

It is understood that the foregoing description is that of the preferred embodiments of the invention and that various changes and modifications may be made thereto without departing from the spirit and scope of the invention as defined in the appended claims.

What is claimed is:

1. A heat exchanger comprising:

a plurality of intermediate plates arranged one atop the other to form a stack of said intermediate plates and said stack having first and second ends;

at least one first fluid channel for through conducting a first fluid;

at least one second fluid channel for through conducting a second fluid;

said intermediate plates being geometrically configured to define at least a portion of each of said first and second fluid channels;

an end plate arranged on one of said ends of said stack and being configured as a connecting plate;

a first inlet opening communicating with said first fluid channel for introducing said first fluid;

a first outlet opening communicating with said first fluid channel for conducting said first fluid out of said heat exchanger;

a second inlet opening communicating with said second fluid channel for introducing said second fluid;

a second outlet opening communicating with said second fluid channel for conducting said second fluid away from said heat exchanger;

said end plate having at least one expansion zone for reducing the stiffness thereof;

said end plate having a first surface facing said stack and defining a first plane and having a second surface facing away from said stack and defining a second plane being parallel to said first plane;

said first inlet opening, second inlet opening, first outlet opening and second outlet opening being formed in said second surface;

said expansion zone being defined by a fluid-tight recess formed in said end plate;

said recess having a thickness that is smaller than a thickness of said end plate; and, said recess being enclosed by said first plane and said second plane.

2. The heat exchanger of claim 1, wherein said expansion zone is defined by a rib or a slot.

3. The heat exchanger of claim 1, wherein said recess is subdividing said end plate into first and second regions; and, said expansion zone further includes at least one strut connecting said first and second regions to each other.

4. The heat exchanger of claim 3, wherein said strut is an extensible rib.

5. The heat exchanger of claim 1, wherein said connecting plate defines a connecting plate plane and each of said intermediate plates defines an intermediate plate plane; and, said connecting plate is expandable parallel to said connecting plate plane to a greater extent than said intermediate plates are expandable parallel to corresponding ones of the intermediate plate planes so as to cause said connecting plate to have an overhang with respect to said stack; and, an arrangement disposed in said overhang for fixing said heat exchanger.

6. The heat exchanger of claim 5, wherein said arrangement comprises a bore formed in said overhang.

7. The heat exchanger of claim 1, wherein said end plate includes a bore for fixing said heat exchanger.

8. The heat exchanger of claim 1, wherein said thickness of said end plate is greater than the thickness of said intermediate plates.

9. The heat exchanger of claim 8, wherein said thickness of said end plate is greater than the thickness of one of said intermediate plates by a factor of at least 1.5.

10. The heat exchanger of claim 8, wherein said thickness of said end plate is greater than the thickness of one of said intermediate plates by a factor of at least 3.

11. The heat exchanger of claim 8, wherein said thickness of said end plate is greater than the thickness of one of said intermediate plates by a factor of at least 2.

12. The heat exchanger of claim 8, wherein said thickness of said end plate is greater than the thickness of one of said intermediate plates by a factor of at least 4.

13. The heat exchanger of claim 1, wherein the thickness of one of said intermediate plates is essentially the same for all of said intermediate plates.

14. The heat exchanger of claim 1, wherein said end plates and/or said intermediate plates are comprised, at least in part, of metal.

15. The heat exchanger of claim 14, wherein said metal is steel or aluminum.

16. The heat exchanger of claim 1, wherein said recess extends completely through said end plate.

17. The heat exchanger of claim 1, wherein said recess extends through said end plate only in part.

18. The heat exchanger of claim 1, wherein said intermediate plates are firmly bonded to each other and/or said end plate and the intermediate plate adjacent thereto are firmly bonded to each other.

19. The heat exchanger of claim 18, wherein the firm bond is achieved with solder.

20. The heat exchanger of claim 1, further comprising a turbulence insert placed in at least one of said first and second fluid channels.

21. The heat exchanger of claim 20, wherein said turbulence insert is attached to two of said intermediate plates.

22. The heat exchanger of claim 21, wherein said turbulence insert is attached with a soldered connection.

23. An internal combustion engine comprising:

a compressor for compressing the charge air to be supplied to said engine; and, a heat exchanger for cooling the charge air compressed by said compressor;

the heat exchanger comprising:

a plurality of intermediate plates arranged one atop the other to form a stack of said intermediate plates and said stack having first and second ends;

at least one first fluid channel for through conducting the charge air;

at least one second fluid channel for through conducting a coolant for transferring the heat of said compressed charge air to said coolant;

said intermediate plates being geometrically configured to define at least a portion of each of said first and second fluid channels;

an end plate arranged on one of said ends of said stack and being configured as a connecting plate;

a first inlet opening communicating with said first fluid channel for introducing said heated compressed air into said heat exchanger;

a first outlet opening communicating with said first fluid channel for conducting said compressed charge air out of said heat exchanger;

a second inlet opening communicating with said second fluid channel for introducing said coolant into said heat exchanger;

a second outlet opening communicating with said second fluid channel for conducting said coolant away from said heat exchanger; and, said end plate having at least one expansion zone for reducing the stiffness thereof;

said end plate having a first surface facing said stack and defining a first plane and having a second surface facing away from said stack and defining a second plane being parallel to said first plane;

said first inlet opening, second inlet opening, first outlet opening and second outlet opening being formed in said second surface;

said expansion zone being defined by a fluid-tight recess formed in said end plate;

said recess having a thickness that is smaller than a thickness of said end plate; and, said recess being enclosed by said first plane and said second plane.

24. The internal combustion engine of claim 23, wherein said compressor is a turbocharger.

* * * * *